US007236693B2

(12) United States Patent
Haugom

(10) Patent No.: US 7,236,693 B2
(45) Date of Patent: Jun. 26, 2007

(54) FLAME SIMULATOR FOR USE IN AN ELECTRIC HEATER

(75) Inventor: Howard Nels Haugom, West Vancouver (CA)

(73) Assignee: Globaltec Fireplaces, Inc., Burnaby, British Columbia (CA)

( * ) Notice: Subject to any disclaimer, the term of this patent is extended or adjusted under 35 U.S.C. 154(b) by 79 days.

(21) Appl. No.: 11/088,630

(22) Filed: Mar. 22, 2005

(65) Prior Publication Data

US 2006/0213097 A1 Sep. 28, 2006

(51) Int. Cl.
*F24B 1/18* (2006.01)

(52) U.S. Cl. ..... 392/348; 362/227

(58) Field of Classification Search ..... None
See application file for complete search history.

(56) References Cited

U.S. PATENT DOCUMENTS

| | | | | |
|---|---|---|---|---|
| 1,586,597 | A | 6/1926 | Berry | |
| 1,719,622 | A | 7/1929 | Price | |
| 1,768,284 | A | 6/1930 | Berry | |
| 1,843,279 | A | 2/1932 | Gritt | |
| 2,285,535 | A | 6/1942 | Schlett | |
| 2,708,114 | A | 5/1955 | Hancock | |
| 2,963,807 | A * | 12/1960 | Relph et al. | 40/428 |
| 3,395,476 | A | 8/1968 | Moss | |
| 3,499,239 | A | 3/1970 | Mungo | |
| 3,526,984 | A | 9/1970 | Nielson | |
| 3,603,013 | A | 9/1971 | Reed | |
| 3,699,697 | A | 10/1972 | Painton | |
| 3,978,598 | A | 9/1976 | Rose | |
| 4,890,600 | A | 1/1990 | Meyers | |
| 4,965,707 | A | 10/1990 | Butterfield | |
| 5,642,580 | A | 7/1997 | Hess | |
| 6,047,489 | A | 4/2000 | Hess | |
| 6,050,011 | A | 4/2000 | Hess | |
| 6,162,047 | A | 12/2000 | Hess | |
| 6,269,567 | B1 | 8/2001 | MacPherson | |
| 6,363,636 | B1 * | 4/2002 | Hess et al. | 40/428 |
| 6,393,207 | B1 * | 5/2002 | Martin et al. | 392/348 |
| 6,718,665 | B2 | 4/2004 | Hess | |
| 2003/0049024 | A1 | 3/2003 | Chen | |

FOREIGN PATENT DOCUMENTS

| | | |
|---|---|---|
| BE | 808538 | 7/1951 |
| CA | 2310343 | 10/1997 |
| CA | 2175442 | 12/1998 |
| CA | 2321716 | 9/1999 |

(Continued)

*Primary Examiner*—Thor Campbell
(74) *Attorney, Agent, or Firm*—Kolisch Hartwell, PC

(57) ABSTRACT

Apparatus is provided for projecting light to simulate flames on a screen for use in an electric fireplace with an imitation flame display. The apparatus comprises a hollow cylinder enclosing an interior region, the cylinder being rotatable about an axis of the cylinder and having a sidewall with an exterior surface and a non-reflective interior surface with apertures through the sidewall. A light source in the interior region is operated to cause light to be transmitted through the apertures onto the screen to simulate moving flames when the cylinder is rotated. This arrangement provides an improved imitation flame display on the screen. When incorporated into an electric fireplace, the apparatus provides a pleasing illusion of active, dancing flames adjacent an artificial log set.

22 Claims, 4 Drawing Sheets

FOREIGN PATENT DOCUMENTS

| | | |
|---|---|---|
| CA | 2299816 | 9/2000 |
| CA | 2299927 | 9/2000 |
| CA | 2204106 | 4/2001 |
| CA | 2310362 | 4/2001 |
| CA | 2310367 | 4/2001 |
| CA | 2310414 | 4/2001 |
| CA | 2310073 | 8/2001 |
| CA | 2302090 | 9/2001 |
| CA | 2459788 | 9/2005 |
| CA | 2459849 | 9/2005 |
| CH | 455683 | 2/1928 |
| CN | 3171066 | 12/2000 |
| CN | 2424392 | 3/2001 |
| CN | 1327138 | 12/2001 |
| CN | 3223188 | 2/2002 |
| CN | 3224234 | 2/2002 |
| CN | 2489234 | 5/2002 |
| CN | 3234875 | 5/2002 |
| CN | 3234876 | 5/2002 |
| CN | 3234877 | 5/2002 |
| CN | 3237118 | 5/2002 |
| CN | 3266861 | 12/2002 |
| CN | 3266862 | 12/2002 |
| CN | 3266863 | 12/2002 |
| CN | 3273400 | 1/2003 |
| CN | 3273401 | 1/2003 |
| CN | 3307916 | 7/2003 |
| CN | 3307917 | 7/2003 |
| CN | 3308068 | 7/2003 |
| CN | 3321210 | 9/2003 |
| DE | 19856742 | 6/2000 |
| EP | 0 348 137 | 12/1989 |
| EP | 0 611 921 | 9/1999 |
| EP | 1020685 | 7/2000 |
| EP | 1 271 060 | 1/2003 |
| EP | 127 1060 | 1/2003 |
| GB | 222060 | 9/1924 |
| GB | 272836 | 6/1927 |
| GB | 272362 | 7/1927 |
| GB | 404302 | 1/1934 |
| GB | 414280 | 8/1934 |
| GB | 427412 | 4/1935 |
| GB | 492893 | 9/1938 |
| GB | 975009 | 11/1964 |
| GB | 1024047 | 3/1966 |
| GB | 1088577 | 10/1967 |
| GB | 1097812 | 1/1968 |
| GB | 2075665 | 11/1981 |
| GB | 2149090 | 6/1985 |
| GB | 2180927 | 4/1987 |
| GB | 2182431 | 5/1987 |
| GB | 2198835 | 6/1988 |
| GB | 2210969 | 6/1989 |
| GB | 2216252 | 10/1989 |
| GB | 2220060 | 12/1989 |
| GB | 2222000 | 2/1990 |
| GB | 2242739 | 10/1991 |
| GB | 2264555 | 9/1993 |
| GB | 2267563 | 12/1993 |
| GB | 2275105 | 8/1994 |
| GB | 2276444 | 9/1994 |
| GB | 2283810 | 5/1995 |
| GB | 2284476 | 6/1995 |
| GB | 2288052 | 10/1995 |
| GB | 2290374 | 12/1995 |
| GB | 2290865 | 1/1996 |
| GB | 2298073 | 8/1996 |
| GB | 2302730 | 1/1997 |
| GB | 2315543 | 2/1998 |
| GB | 2317224 | 3/1998 |
| GB | 2321700 | 8/1998 |
| GB | 2350420 | 11/2000 |
| GB | 2350670 | 12/2000 |
| GB | 2350887 | 12/2000 |
| GB | 2353352 | 2/2001 |
| SU | 1290038 | 2/1987 |
| WO | WO-0057109 | 9/2000 |
| WO | WO-0104544 | 1/2001 |
| WO | WO-0235153 | 5/2002 |

* cited by examiner

FLAME SIMULATOR FOR USE IN AN ELECTRIC HEATER

FIELD OF THE INVENTION

The present invention relates generally to electric heaters with imitation flame displays, and more particularly, to a flame simulating apparatus for generating the appearance of flames in such an imitation fireplace electric heater.

BACKGROUND OF THE INVENTION

There exist electric fireplaces flame simulators in which light from a light source is projected up through a rotating cylinder, through a coloured filter screen and onto a reflective screen. There also exist flame simulators in which light from a light source is reflected from a metallic strip onto a rotating set of coloured metallic strips and then projected through a flame effect element before being finally reflected from a mirror to an observer.

Our pending Canadian Patent application No. 2,459,788 filed Mar. 5, 2004, the disclosure of which is incorporated herein by reference, discloses a flame simulating apparatus for use in an electric fireplace to project imitation flames onto a screen of the fireplace.

Our pending Canadian application No. 2.459,849 filed Mar. 5, 2004, the disclosure of which is incorporated herein by reference, discloses a flame simulating apparatus with cooling features for use in an electric fireplace to display imitation flames on a screen.

SUMMARY OF THE INVENTION

The present invention provides an improved apparatus for projecting light to simulate flames on a screen, and an electric fireplace incorporating the apparatus to creates an interesting and pleasing imitation flame pattern visible on a screen within the fireplace.

Accordingly, the present invention provides apparatus for projecting light to simulate flames on a screen, the apparatus comprising:

a hollow cylinder enclosing an interior region, the cylinder being rotatable about an axis of the cylinder and having a sidewall with an exterior surface and a non-reflective interior surface with apertures through the sidewall; and a light source in the interior region operable to cause light to be transmitted through the apertures onto the screen to simulate moving flames when the cylinder is rotated.

The apparatus is simple in structure for reliable operation and formed using inexpensive parts.

In a further aspect, the present invention provides an electric fireplace with imitation flames comprising:

an enclosure;

an electric heater unit within the enclosure;

a simulated fuel source within the enclosure; and a flame simulation apparatus for generating the appearance of flames, the flame simulation apparatus comprising:

a light diffusing panel adjacent the simulated fuel source;

a flame effect mask positioned adjacent the light diffusing panel;

a hollow cylinder enclosing an interior region, the cylinder being rotatable about an axis of the cylinder and having a sidewall with an exterior surface and a non-reflective interior surface with apertures through the sidewall; and a light source in the interior region operable to cause light to be transmitted through the apertures of the cylinder sidewall, past the flame effect mask for projection onto the light diffusing panel for display as simulated moving flames when the cylinder is rotated.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
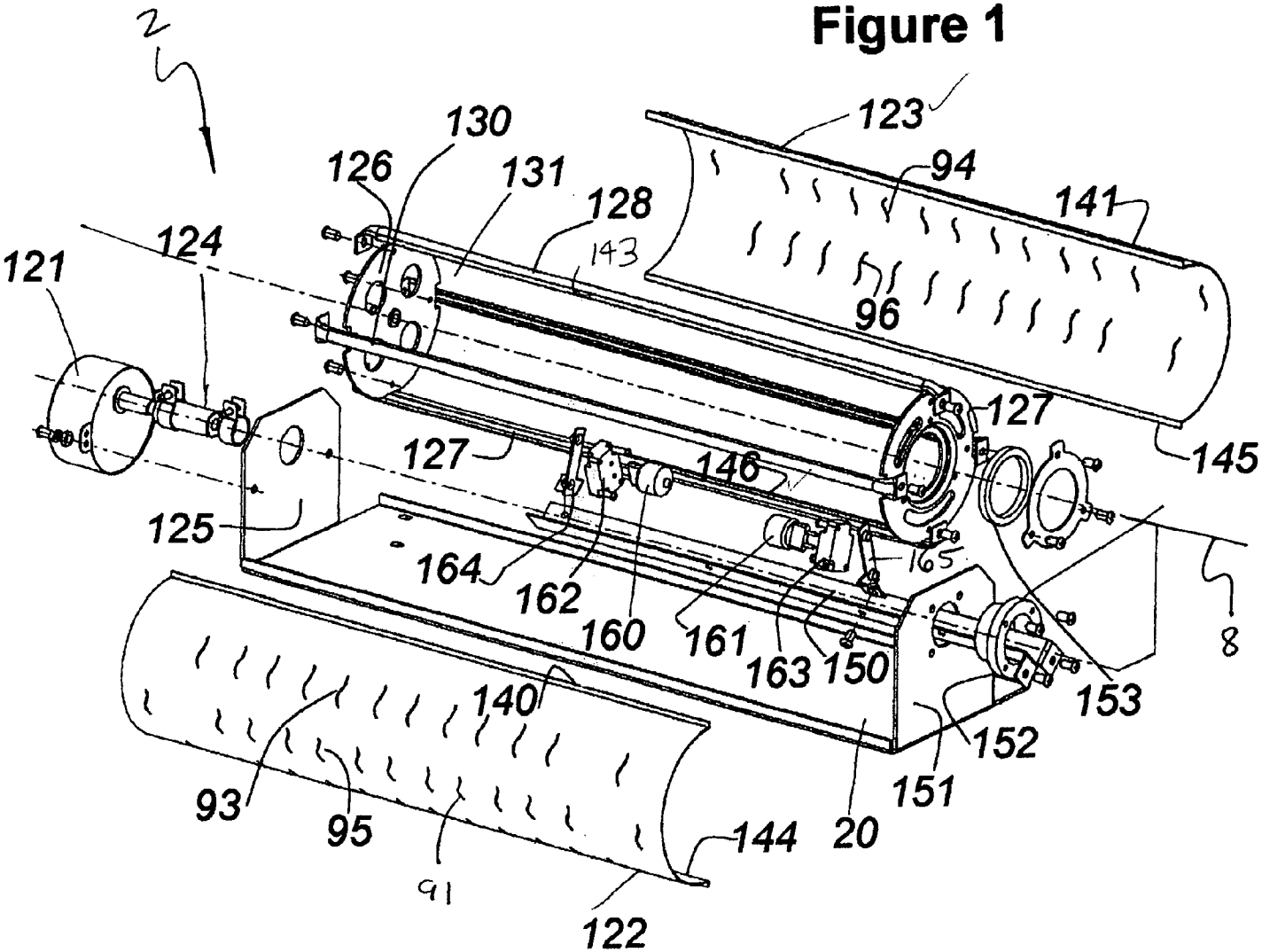
FIG. 1 is an exploded perspective view showing an embodiment of the apparatus for projecting light to simulate flames according to the present invention.
Figure 2:
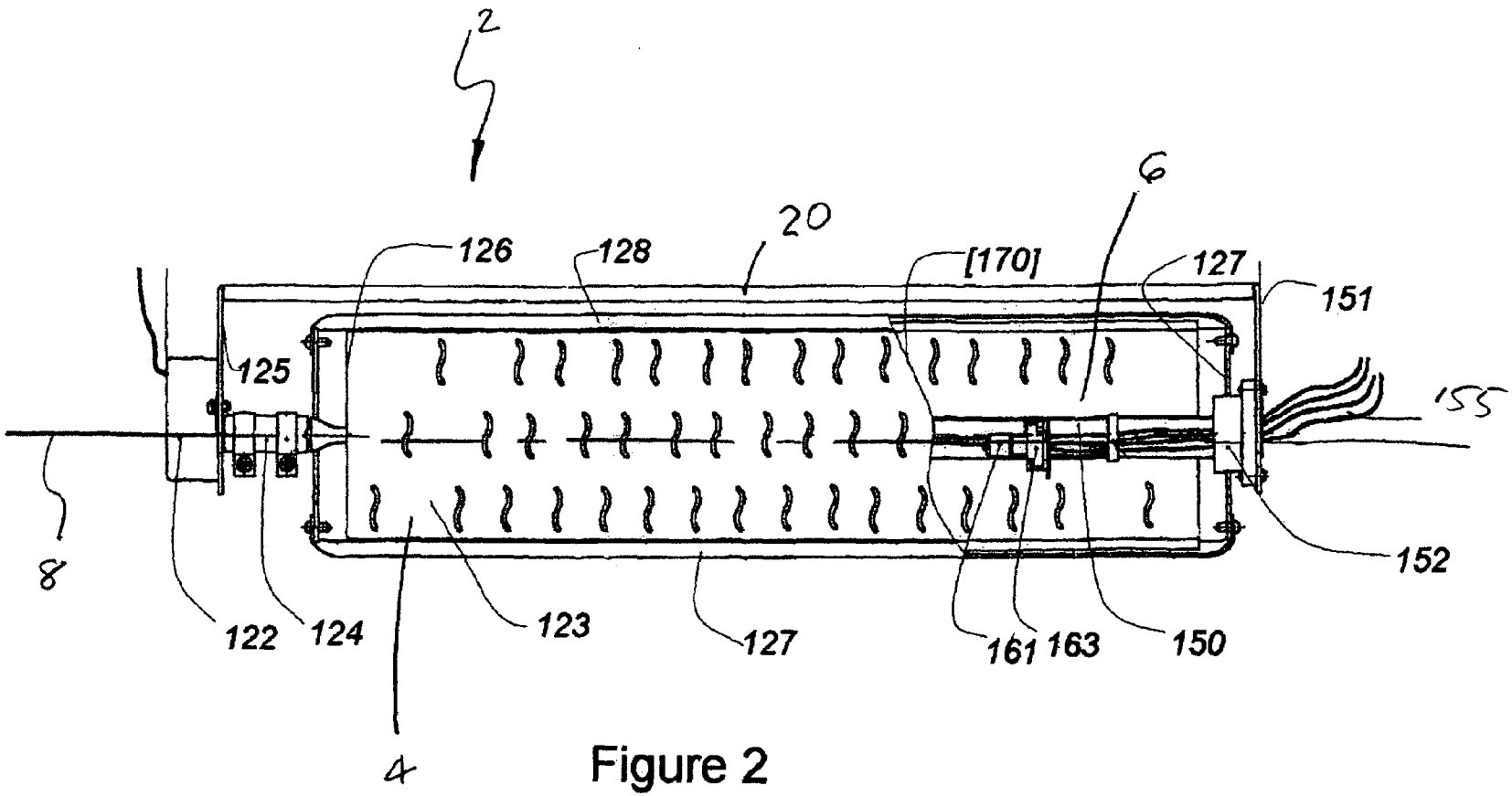
FIG. 2 is a side view, partially in cross-section, of the assembled apparatus of FIG. 1.

Referring to FIGS. 1 and 2, there is shown apparatus 2 for projecting light to simulate flames on a screen according to a preferred embodiment of the present invention. As best shown in its assembled state in FIG. 2, the apparatus includes a hollow cylinder 4 enclosing an interior region 6. The hollow cylinder is rotatable about an axis 8 of the cylinder. As best shown in the exploded view of FIG. 1, hollow cylinder 4 is preferably formed as a modular structure that includes a pair of attached panels 122 and 123 which define the sidewall of the cylinder. A mounting frame 20 holds a motor 121 at one end that rotatably drives the hollow cylinder 4 for rotation about axis 8. A motor drive rod 124 is inserted through frame end bracket 125 to engage with an end plate 126 of cylinder 4. End plate 126 is connected to another end plate 127 by an array of retaining rods 128, 129, 130 and 131. End plate 127 acts as a support for a light source 160, 161 positioned within the interior region 6 of the cylinder. Retaining rods 128, 129 130 and 131 form a mounting system extending between end plates 126 and 127 for removably securing panels 122 and 123 between the end plates. When secured between end plates 126 and 127, panels 122 and 123 form the sidewall of cylinder 4 to establish interior and exterior surfaces of the cylinder. The plurality of retaining rods preferably comprise a top flange retaining rod 128, a bottom flange retaining rod 129, and a pair of panel backing rods 130 and 131. The cylinder sidewall is assembled by squeezing together the edges of panels 122 and 123 such that top flanges 140 and 141 on the edges are positioned adjacent a retaining channel 143 in top flange retaining rod 128. Release of the edges results in the flanges being biased apart by the inherent resiliency of the panels to be retained in channel 143. Similarly, bottom flanges 144 and 145 on the panels are squeezed and then released to fit within a retaining channel 146 formed in bottom flange retaining rod 129. Panels 122 and 123 have their interior surfaces positioned over panel backing retaining rods 130 and 131 when the flanges are positioned in channels 143 and 146 to assist in maintaining the cylindrical shape of the panels.

Panels 122 and 123 are preferably formed from a thin resilient sheet material, such as thin sheet metal, that can be shaped into a pliable, semi-cylindrical configuration, and folded along its long edges to form top flanges 140, 141 and bottom flanges 144,145.

Still referring to FIGS. 1 and 2, a light source, preferably in the form of bulbs 161 and 162 retained in sockets 162 and 163, is mounted to a light source rod 150 which is inserted through frame end bracket 151 of frame 20 along rotation axis 8 of cylinder 4 to position the light source within the interior of the cylinder. Bulb sockets 162, 163 are attached to rod 150 by brackets 164 and 165, respectively. Rod 150 is fixedly secured to frame 20 at end bracket 151 by collar 152. Quiet and smooth rotation of cylinder 4 by motor 121 about axis 8 is achieved using a rotator bushing 153 that rotatably supports end plate 127 of the cylinder. As shown in FIG. 2, wires 155 to supply electrical power to bulbs 161 and 162 enter the interior 6 of cylinder 4 through aligned openings in end plate 127, bushing 153, end bracket 151 and collar 152. It will be appreciated by a person skilled in the art that other arrangements to position a light source within the interior 6 of cylinder 4 are possible.

The above described panel mounting arrangement and the light source mounting scheme permit ready access to the bulbs within interior 6 of cylinder 4 to permit changing of bulbs in the event of a bulb failure.

Panels 122 and 123 forming the sidewall of cylinder 6 are formed with apertures 91 therethrough. Rotation of cylinder 4 by motor 121 causes the apertures to rotate about cylinder axis 8. Light from light bulbs 161 and 162, which are stationary within interior 6 of the cylinder, is transmitted through the moving apertures for display on a screen in order to create a simulation of moving and flickering flames.

It has been discovered the imitation flame display is enhanced if the interior surface of panels 122 and 123 are non-reflective or light absorbing. For example, in a preferred arrangement, the interior surfaces of panels 122 and 123 facing the interior 6 of cylinder 4 may be formed with a matte black surface. Such a surface can be created by applying a matte black paint to the interior panel surfaces. It will be apparent to one of skill in the art that other non-reflective or light absorbing surfaces may be used by forming the panels of non-reflective material or by applying other non-reflective coating to the interior surfaces of the panels. For example, the application of any dull, flat finish by painting or otherwise to the interior surface of the drum will create the necessary non-reflective surface as opposed to the use or application of a surface having a smooth, glossy finish with a shine or luster. It is also possible for the exterior panel surfaces to be non-reflective or light absorbing.

Figure 3:
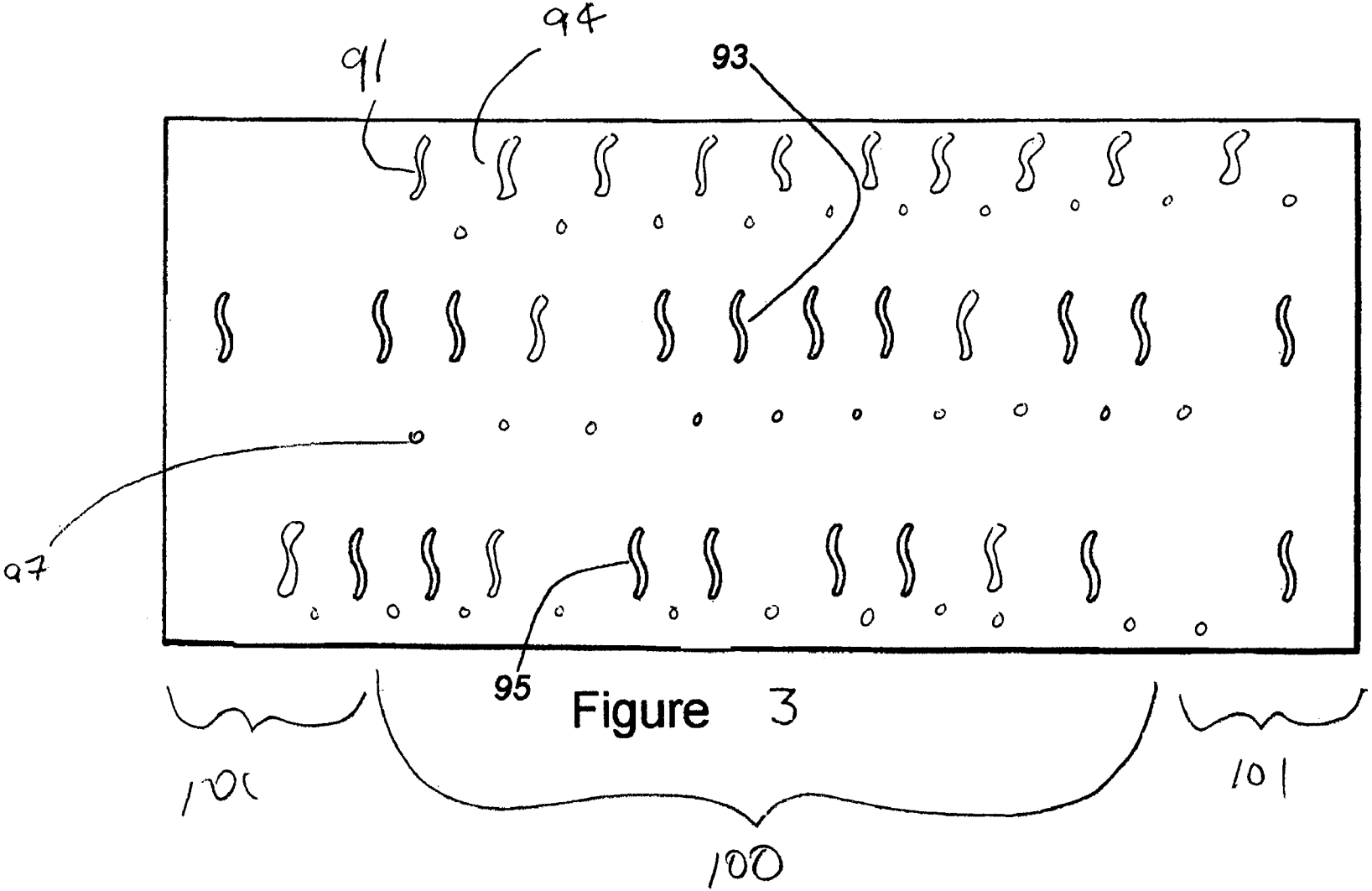
FIG. 3 is a detail view of a panel of the present invention formed with an array of apertures.

As best shown in FIG. 3, the apertures in panels 122 and 123 are preferably formed as curved, generally S-shaped perforations 91 or circular perforations 97 through the panels. The apertures are preferably stamped or molded in a pattern or array suitable for generating a flame display when projected onto a screen. In the illustrated embodiment of FIG. 3, generally flattened S-shaped perforations 91 are arranged in rows 93, 94 and 95 with the perforations in each row being offset or staggered from the perforations in an adjacent row. Circular perforations 97 are also formed in offset rows. Other aperture shapes and arrays of apertures are possible. The staggering of the perforations 91 tends to create a waved flickering effect as the cylinder rotates that better simulates real flames in the flame display.

The central zone 100 of each panel can be formed with more apertures than the end zones 101 of the panel to create a brighter central region with more imitation flames in the flame display. Alternatively, having brighter bulbs or a greater concentration of bulbs positioned in the central region of interior 6 of cylinder 4, or a combination of both such arrangements will achieve the same effect of a brighter central region in the imitation flame display.

Figure 4:
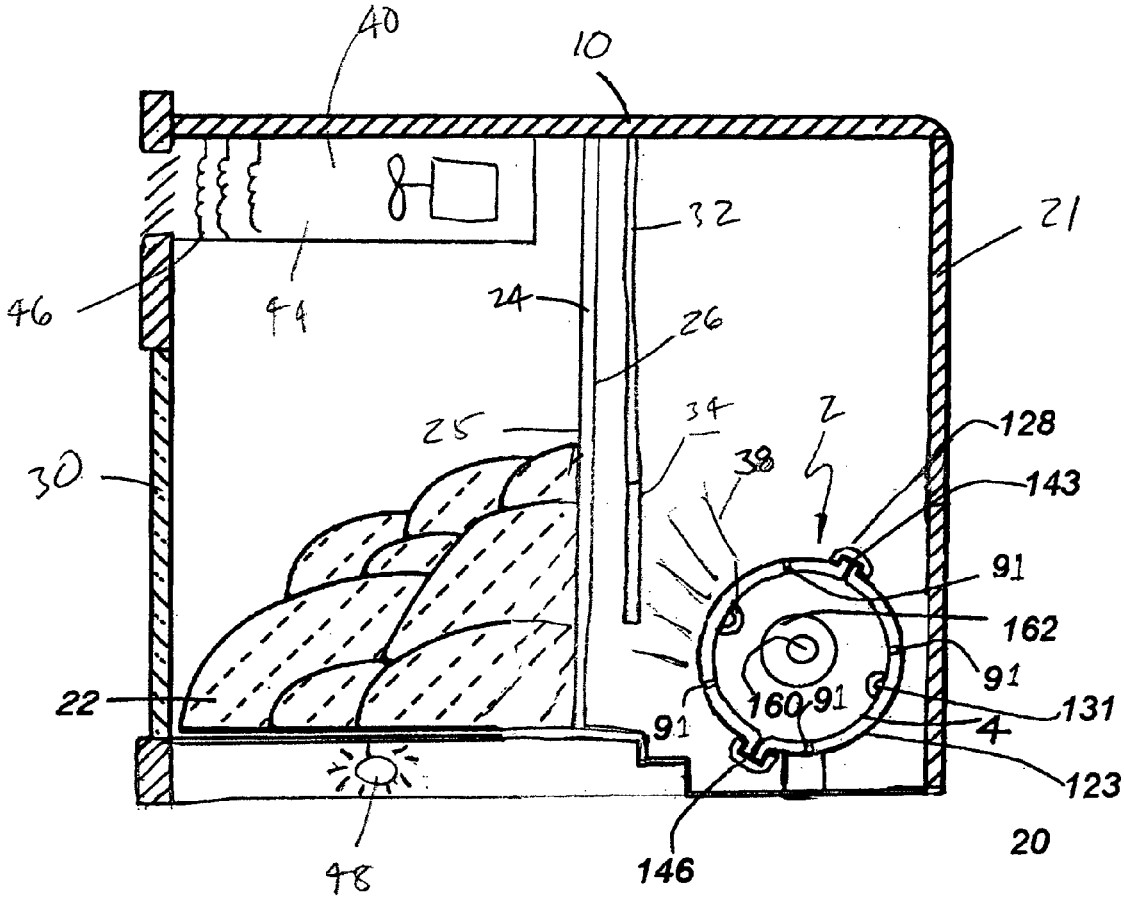
FIG. 4 is an end cross-section view of the assembled apparatus of FIG. 1 in place within an electric fireplace with a "flame simulation apparatus"

Referring to FIG. 4, the apparatus 2 for projecting light of the present invention is shown installed in an electric fireplace 10 designed to display imitation flames on a screen 24. FIG. 4 is a cross-sectional elevation view through the electric fireplace unit. Hollow cylinder 4 is mounted at the rear of an enclosure 21 behind a simulated fuel source 22 at the front of the enclosure, which is positioned in front of screen 24. Simulated fuel source 22 comprises an artificial log or charcoal arrangement. Screen 24 comprises a translucent panel having a rear facing side 26 onto which moving flames are back-projected from apparatus 2 for viewing from a front facing side 25. Simulated fuel source 22 and the front facing side 25 of screen 24 are viewable through a front window 30 of the fireplace enclosure 21.

The front facing side 25 of screen 24 preferably has reflective properties such that a reflection of the simulated fuel source 22 may be seen on the front facing side 25 of screen 24. A portion of the front facing side 25 may optionally feature a "brick" pattern of alternating substantially non-reflective portions and substantially reflective portions.

The rear facing side 26 is optionally coated or provided with a frosted coating or sheet (not shown) that causes the light to diffuse as it passes through screen 24. Such a diffusion coating or sheet softens or blurs the edges of the imitation flames in the flare display.

Figure 5:
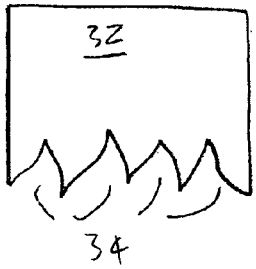
FIG. 5 is a detail view of a flame effect mask shown in the electric fireplace embodiment of FIG. 4.

Also mounted within fireplace enclosure 21 directly behind screen 24 is a flame effect mask 32. FIG. 5 provides a front view of the mask which is an opaque surface having a lower edge formed with generally triangular cut outs 34. Mask 32 acts to block some of the light emitted by cylinder 4 to create a more realistic imitation flame display on screen 24.

The arrangement of cylinder 4, flame effect mask 32 and screen 24 is such that light 38 transmitted through the rotating apertures 91 of the hollow cylinder 4 and past the flame effect mask 32 is projected onto rear facing side 26 of screen for display on a front facing side 25 as simulated moving flames above artificial fuel source 22.

Screen 24 comprises a light diffusing panel that can be made of molded plastic that is translucent but not transparent, in order to soften and diffuse the light that is projected through the perforations of cylinder 4 producing a variable glow that enhances the simulation of flames while at the same time preventing viewing of cylinder 4 through the panel.

The electric fireplace of the present invention as shown in FIG. 4 can also incorporate a heater unit 40 comprising a conventional electrical heater 44 with heater coils 46 and a blower fan 51 for directing air past the coils. A second light source 48 can be positioned below artificial fuel source 22 to provide a glow of burning embers below the artificial logs or coals of the artificial fuel source.

The fireplace is fitted with other standard components such as an on-off switch, a thermostat, and an overheat control circuit which allow the fireplace to be assembled into a unit that is functional, heat-producing, controllable, and safe.

Although the present invention has been described in some detail by way of example for purposes of clarity and understanding, it will be apparent that certain changes and modifications may be practised within the scope of the appended claims.

I claim:

1. Apparatus for projecting light to simulate flames on a screen, the apparatus comprising:

a hollow cylinder enclosing an interior region, the cylinder being rotatable about an axis of the cylinder and having a sidewall with an exterior surface and a matte black interior surface with apertures through the sidewall; and a light source in the interior region operable to cause light to be transmitted through the apertures onto the screen to simulate moving flames when the cylinder is rotated.

2. The apparatus of claim 1 wherein the matte black surface is formed by applying a matte black paint to the interior surface.

3. The apparatus of claim 1 wherein the exterior surface of the cylinder is non-reflective.

4. The apparatus of claim 1 wherein the cylinder is rotated by a motor.

5. The apparatus of claim 1 wherein the cylinder comprises:

an array of retaining rods; and panels configured to removably connect to the retaining rods, the panels forming the sidewall of the cylinder to define the interior and exterior surfaces of the cylinder.

6. The apparatus of claim 1 wherein a plurality of the apertures are curved.

7. The apparatus of claim 6 wherein the apertures are curved and circular.

8. The apparatus of claim 1 wherein the screen comprises a translucent panel having a first side onto which the moving flames are back-projected for viewing from a second side.

9. The apparatus of claim 1 further comprising:

an enclosure housing the screen;

a simulated fuel source within the enclosure, a flame effect mask positioned adjacent the screen;

wherein the screen comprises a light diffusing panel adjacent the simulated fuel source whereby light transmitted through the apertures of the hollow cylinder and past the flame effect mask is projected onto a first side of the light diffusing panel for display on a second side of the light diffusing panel as simulated moving flames.

10. The apparatus of claim 9 further comprising an heater unit.

11. The apparatus of claim 10 in which the heater unit comprises an electric heater and a blower fan for producing heated air.

12. The apparatus of claim 9 including a motor for rotating the hollow cylinder.

13. An electric fireplace with imitation flames comprising:

an enclosure;

an electric heater unit within the enclosure;

a simulated fuel source within the enclosure, and a flame simulation apparatus for generating the appearance of flames, the flame simulation apparatus comprising:

a light diffusing panel adjacent the simulated fuel source;

a flame effect mask positioned adjacent the light diffusing panel;

a hollow cylinder adjacent the flame effect mask enclosing an interior region, the cylinder being rotatable about an axis of the cylinder and having a sidewall with an exterior surface and a matte black interior surface with apertures through the sidewall; and a light source in the interior region operable to cause light to be transmitted through the apertures of the cylinder sidewall, past the flame effect mask for projection onto the light diffusing panel for display as simulated moving flames when the cylinder is rotated.

14. The electric fireplace of claim 13 in which the light is projected onto a first side of the light diffusing panel for display on a second side of the light diffusing panel as simulated moving flames.

15. The electric fireplace of claim 13 wherein the matte black surface is formed by applying a matte black paint to the interior surface.

16. The electric fireplace of claim 13 wherein the exterior surface of the cylinder is non-reflective.

17. The electric fireplace of claim 13 in which the heater unit comprises an electric heater and a blower fan for producing heated air.

18. Apparatus for projecting light to simulate flames on a screen, the apparatus comprising:

a hollow cylinder forming an interior space about an axis, the cylinder having apertures and having an exterior surface and a matte black interior surface, means for rotating the cylinder about said axis, and a light source in the interior space operable to cause light to be emitted through said apertures onto said screen to simulate moving flames when said cylinder is rotated.

19. The apparatus of claim 1 in which the screen is formed with a brick pattern.

20. The apparatus of claim 19 in which the brick pattern is formed by alternating substantially non-reflective portions and substantially reflective portions on one of a first and a second side of the screen.

21. The apparatus of claim 14 in which the light diffusing panel includes a brick pattern formed on one of the first and second sides.

22. The apparatus of claim 21 in which the brick pattern is formed by alternating substantially non-reflective portions and substantially reflective portions on one of the sides of the light diffusing panel.

* * * * *